US007055452B1

(12) United States Patent
Whittemore et al.

(10) Patent No.: US 7,055,452 B1
(45) Date of Patent: Jun. 6, 2006

(54) SPRAY SKIRT WITH RIGID DECK

(75) Inventors: Jess P. Whittemore, Friendsville, MD (US); John F. Weld, IV, Confluence, PA (US)

(73) Assignee: Immersion Research, Inc., Confluence, PA (US)

( * ) Notice: Subject to any disclaimer, the term of this patent is extended or adjusted under 35 U.S.C. 154(b) by 0 days.

(21) Appl. No.: 10/935,854

(22) Filed: Sep. 8, 2004

Related U.S. Application Data

(60) Provisional application No. 60/501,056, filed on Sep. 8, 2003.

(51) Int. Cl.
*B63B 35/00* (2006.01)

(52) U.S. Cl. ..... 114/347

(58) Field of Classification Search ..... 114/347
See application file for complete search history.

(56) References Cited

U.S. PATENT DOCUMENTS 4,699,076 A * 10/1987 Curtis et al. ..... 114/347
4,727,821 A * 3/1988 Masters ..... 114/347
5,076,194 A * 12/1991 Curtis et al. ..... 114/347

* cited by examiner

*Primary Examiner*—Jesus D. Sotelo

(74) *Attorney, Agent, or Firm*—Christine W. Trebilcock, Esq.; Alicia M. Passerin, Esq.; Cohen & Grigsby, P.C.

(57) ABSTRACT

The invention is a rigid-decked spray skirt for use with a kayak operable to fit about the cockpit rim. A rigid deck member under the flexible spray skirt rests on the cockpit rim and spans the front portion of the cockpit opening. The invention also comprises a rigid deck plate for use with a flexible kayak spray skirt. The rigid deck plate is arc-shaped and is substantially congruous with the front portion of the cockpit opening. The rigid plate member covers the front portion of the cockpit opening. In this way the rigid deck plate provides support to flexible spray skirts used with kayaks. The invention further comprises a spray skirt that is substantially rigid. Still further, in another embodiment, the front portion of the spray skirt is substantially rigid, while the remainder of the spray skirt is flexible.

13 Claims, 7 Drawing Sheets

SPRAY SKIRT WITH RIGID DECK

CLAIM OF PRIORITY

This application claims priority to U.S. Provisional Application No. 60/501,056 filed Sep. 8, 2003.

FIELD OF THE INVENTION

This invention relates generally to kayaks and, more specifically, to spray skirts used with kayaks.

BACKGROUND OF THE INVENTION

In the sport of kayaking, there are five pieces of essential gear: a boat, a paddle, a helmet, and a personal flotation device (PFD), and a spray skirt. The spray skirt is a garment worn around the waist of the paddler that stretches around the cockpit rim of the kayak, thereby keeping water out of the boat while in use. The spray skirt also allows for easy access and egress from the craft when necessary. There are a number of popular designs for spray skirts available today, but all of those designs relate to spray skirts that consist essentially of various flexible fabrics, like neoprene or waterproof nylon. These soft materials, while comfortable and easy to manufacture to fit a wide variety of cockpit sizes, also have several inherent problems that are particularly evident during high-performance whitewater paddling.

Conventional spray skirts have two main parts: a tunnel, which is meant to fit tightly around the torso of the paddler, and a deck, which is meant to keep water out of the boat by stretching over and fitting tight around the opening of the cockpit of the boat. Skirts of the prior art are almost all made with two types of fabric. Those fabrics are either a waterproof fabric such as urethane coated nylon, or neoprene. Urethane coated nylon, for example, has little to no stretch capacity and therefore is unable to provide the strong seal necessary for whitewater applications. Neoprene, on the other hand, is both waterproof and very stretchable, and thereby fits a wider variety of boats and torsos in one size. But a drawback to neoprene is that it is expensive. Neoprene also makes the kayak susceptible to implosion and it compromises the buoyancy of the kayak as will be discussed below. Further, neoprene is heavy.

Conventionally, the deck is kept in place on the cockpit by fitting underneath a cockpit rim, which is a curved lip around the top of the entire cockpit. A cockpit rim is necessary for a typical spray skirt to work, and is a standard feature on all kayak cockpits. There are three common ways to keep the deck snug underneath the cockpit rim. On the more basic non-stretchable skirts, a snug fit with the cockpit rim is accomplished with a draw cord. On the higher end neoprene skirts, and tight fit is accomplished by either a bungee cord sewn on the perimeter or outer edge of deck of the skirt, or an elastic material band secured to the perimeter or outer edge deck of the skirt.

While soft deck skirts are easy to manufacture and fit a wide variety of boats, soft deck skirts have design drawbacks. Those drawbacks are as follows: spray skirt "implosions" due to excessive water pressure, the susceptibility of the soft skirt to distort due to water pressure and thereby adversely affecting the performance of the kayak in high end whitewater maneuvers, and the inability of soft deck skirts to house, hold or protect technical equipment often used in extended kayak touring trips.

Each problem will be briefly discussed. Spray skirt implosions most often occur when a large volume of water breaks on top of the kayak and pushes the skirt down between the paddler's knees. This challenges the seal of the skirt under the cockpit rim to the point of failure, and in the worst case, the skirt releases and the boat fills with water.

Performance is also compromised by soft decked skirts. Cork-like recoil is a necessary feature for high-performance whitewater kayaking. For example, tricks involving plunging or submerging the kayak below the surface of the water such that the kayak shoots above the surface with sufficient strength require this cork-like recoil. Often times these tricks involve the paddler pushing the boat into the water well past the cockpit area. Traditional soft deck skirts during these maneuvers oftentimes push deep with in the cockpit area of the boat creating drag and/or reduced buoyancy, thereby compromising the performance of the cork-like recoil necessary for the completion of these maneuvers.

Finally, soft-decked skirts cannot hold instrumentation. Touring kayakers have a need for visual access to a variety of instruments during open water paddling and currently the paddler would have to carry the instruments inside the boat or attached somewhere on their body requiring frequent stops to check the instruments. During heavy weather this would be very inconvenient. Soft deck skirts do not offer any solution to this problem. Not only do soft deck skirts fail to offer a stable, protective mounting place for the instruments, any instrumentation attached on to a soft deck skirt would weigh the skirt down making it more likely that water would pool on it and also more likely to implode.

SUMMARY OF THE INVENTION

In one embodiment, the invention is a rigid-decked spray skirt for use with a kayak comprising a flexible skirt portion having a front portion and a rear portion, the spray skirt having an inward-facing portion, an outward-facing portion, and an edge operable to fit about the cockpit rim. A rigid deck member under the flexible spray skirt rests on the cockpit rim and spans the front portion of the cockpit opening. In this way the rigid support member provides support to a flexible spray skirt worn by the paddler and secured to the cockpit rim.

In another embodiment, the invention comprises a rigid deck plate for use with a flexible kayak spray skirt. The rigid deck plate is arc-shaped and is substantially congruous with the front portion of the cockpit opening. The rigid plate member covers the front portion of the cockpit opening. In this way the rigid deck plate provides support to flexible spray skirts used with kayaks.

In another embodiment of the invention, the invention comprises a spray skirt that is substantially rigid.

Still further, in another embodiment, the front portion of the spray skirt is substantially rigid, while the remainder of the spray skirt is flexible.

It is an object of the present invention to reduce the risk of implosion of the spray skirt.

It is an object of the present invention to provide a device that will allow a kayak to maintain high levels of buoyancy.

It is another object of the present invention to provide a device that will allow instruments to be mounted to the skirt without compromising the effectiveness.

Other objects and features are apparent by reading the specification and claims.

DESCRIPTION OF THE PRESENTLY PREFERRED EMBODIMENT

Figure 1:
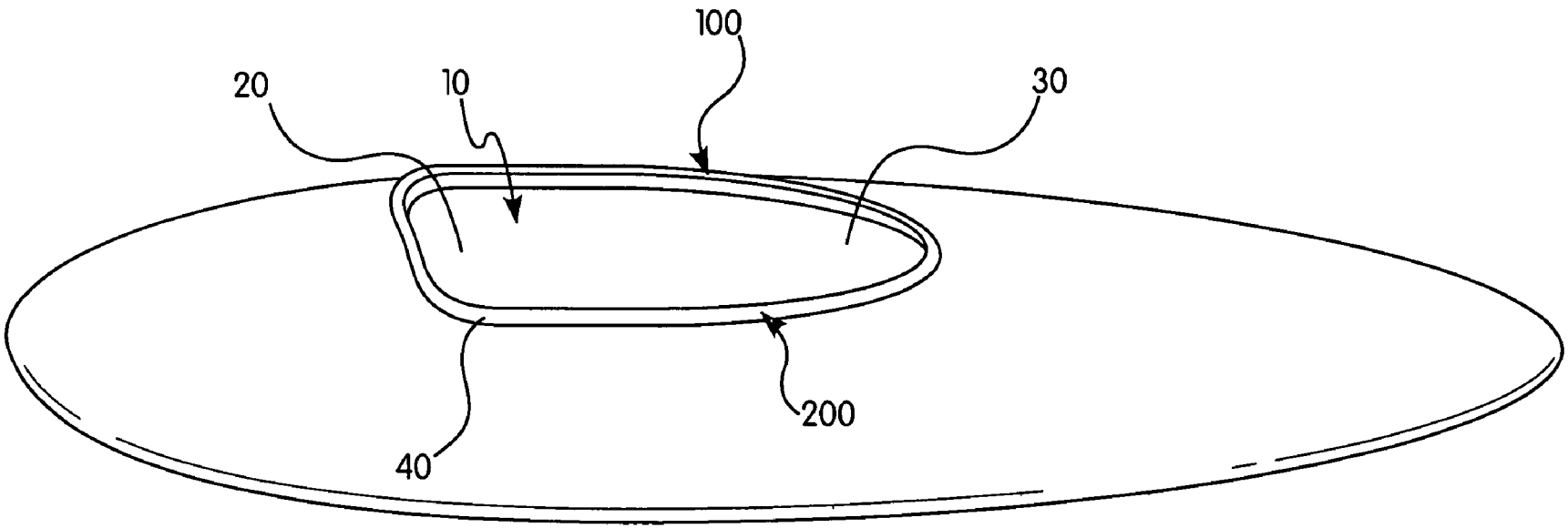
FIG. 1 is a side schematic view of the watercraft to which this invention pertains.

FIG. 1 shows a kayak having a conventional cockpit opening 10 having a front portion 30 and a rear portion 20. Conventionally, the opening has a cockpit rim 40. The cockpit rim 40 is a curved portion or lip that runs around the cockpit opening 10.

Figure 2:
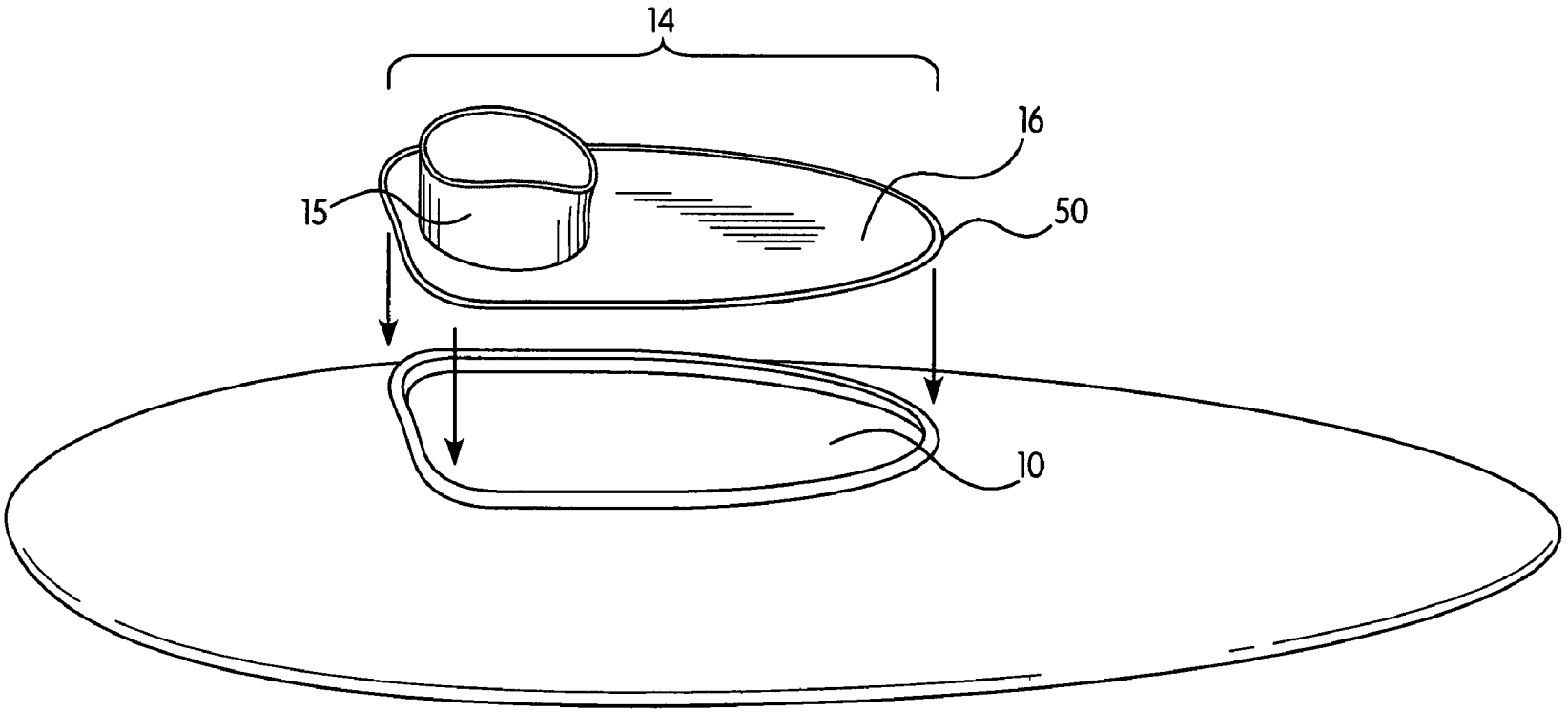
FIG. 2 is a side schematic view of an embodiment of the present invention.
Figure 3B:
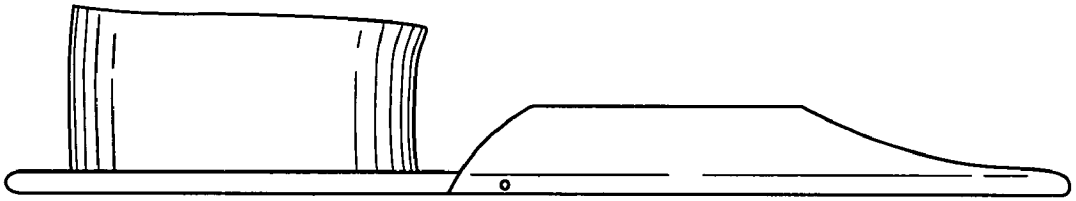
FIGS. 3A, 3B and 3C are top view, side view and cross-sectional view respectively of an embodiment of the present invention wherein a rigid front portion of the deck is combined with a rear flexible portion.
Figure 3C:
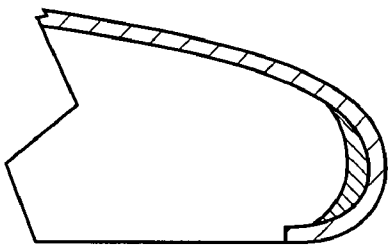
Figure 3A:
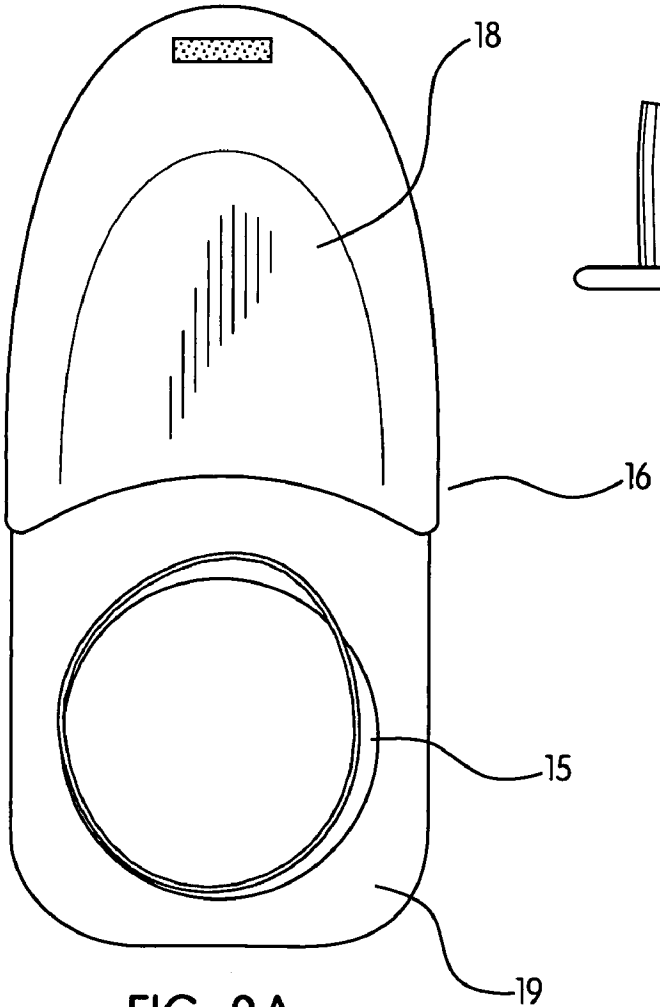

In one embodiment shown in FIG. 2, the spray skirt 14 comprises a cylindrical tunnel portion 15 that can be integral with or secured to deck 16 of the spray skirt 14. In this embodiment, the tunnel 15 is made of a flexible material, such as neoprene. Preferably, the tunnel 15 is connected to the deck 16 of the spray skirt 14 by means of an adhesive or stitching. Except for the opening provided by the tunnel, the deck 16 covers the entire cockpit opening 10. The deck 16 is substantially rigid. In an alternative embodiment shown in FIG. 3, only the front portion 18 of the deck 14 is rigid, while the deck material behind the tunnel (the rear portion of the deck) 19 is flexible. The rigid front portion 18 of such an embodiment is secured to the nonrigid back portion 19, preferably by stitching on an adhesive. The rigid deck can be manufactured to fit over the cockpit opening and to be detachably secured to the cockpit rim 40 of the kayak.

Often, however, sizes of cockpit openings, and thus cockpit rims, vary considerably. Since manufacture of a one or several standardized sizes of spray skirts is desirable, an alternative embodiment of the present invention includes a rigid deck or a rigid deck front portion having a flexible material 50 secured to its perimeter or the outer edges that is congruous with the cockpit rim 40. Preferably, the flexible material 50 can be integral with or have secured thereto a securing means, preferably an elastic material or a material with an elastic material embedded therein, that is able to stretched over the cockpit rim 40 and provide a snug fit thereto. The skilled artisan will appreciate that there may be other ways to connect the flexible edge material to the cockpit rim, such as VELCRO® or snap-type fasteners. Except for the opening provided by the tunnel 15, the rigid deck 16 substantially covers the cockpit opening with the flexible perimeter covering any small part of the opening not covered by the rigid deck. In an alternate embodiment shown in FIGS. 3A, 3B and 3C, only the front portion 18 of the deck is rigid leaving the tunnel 15 along with the rear deck material 19 behind the tunnel 15 flexible. In such embodiments, the flexible securing material will be secured to the entire perimeter of the skirt or portions thereof, and hence will be secured to the cockpit rim or corresponding portions thereof.

Figure 4A:
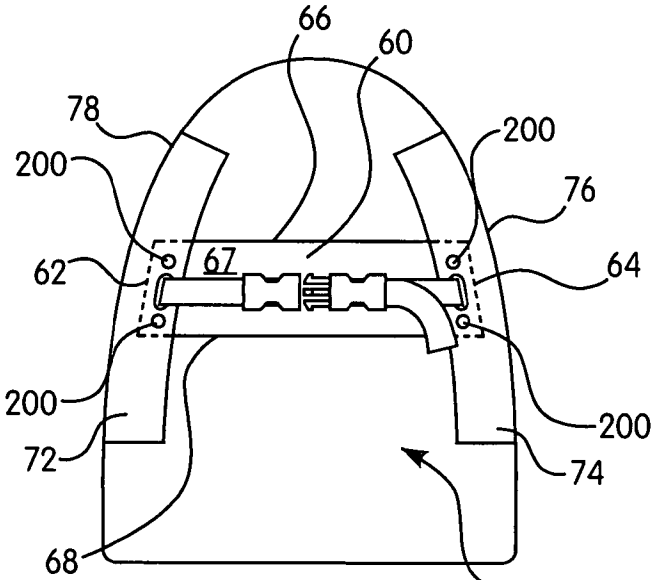
FIGS. 4A and 4B are a bottom view and a side schematic view respectively of an embodiment of the present invention wherein a rigid member is provided to support a flexible spray skirt.
Figure 4B:
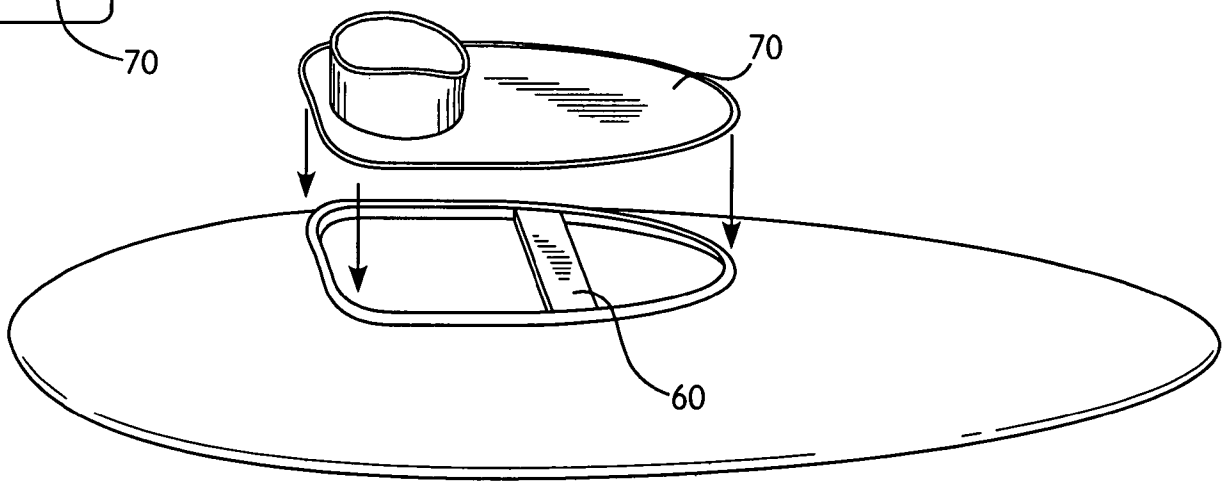

In another embodiment shown in FIGS. 4A and 4B, a rigid deck member 60 is provided. The rigid deck member 60 is preferably generally trapezoidal shaped. The rigid deck member 60 comprises two side edges 62, 64 a front edge 66 and a back edge 68. The side edges 62, 64 are generally congruous with a portion or portions (100 and 200 shown in FIG. 1) of the cockpit rim 40 over which the rigid member 60 is placed. The rigid member 60 also has an inward facing surface 67 and outward facing surface (not shown). The rigid deck member 60 spans a portion of the front portion 30 of the cockpit opening 10. Preferably, a flexible spray skirt portion 70 is placed over the rigid member 60. Preferably the perimeter or outer edge of flexible spray skirt portion 70 is integral with or secured to a securing means, preferably an elastic material or a material with an elastic material embedded therein, that is able to be stretched over the cockpit rim 40 thereby providing a snug fit. The skilled artisan will appreciate that there may be other ways to connect the flexible edge material (and therefore the flexible skirt) to the cockpit rim, such as VELCRO® or snap-type fasteners. Since the flexible spray skirt portion 70 is secured to the cockpit rim 40 while being preferably placed over the rigid member 60, the flexible skirt portion 70 prevents the rigid member 60 from moving out of the cockpit. The rigid member 60 is preferably further held in place by fastening the rigid member 60 to the spray skirt 70. One embodiment comprises a fastening means on an inward facing surface of the flexible skirt portion that cooperates with a fastening means on the outward facing layer of the rigid deck member, for example VELCRO® or a snap-type fastener. In another embodiment shown in FIG. 4A, securing tabs 72, 74 are provided to a portion of the outer edge 76, 78 of the flexible skirt portion 70 on each side. The securing tabs wrap 72, 74 around the side edges 62, 64 of rigid support member and are optionally provided with fasteners 200 that fasten onto fasteners (not shown) on the inward facing portion of the rigid support member.

Figure 5A:
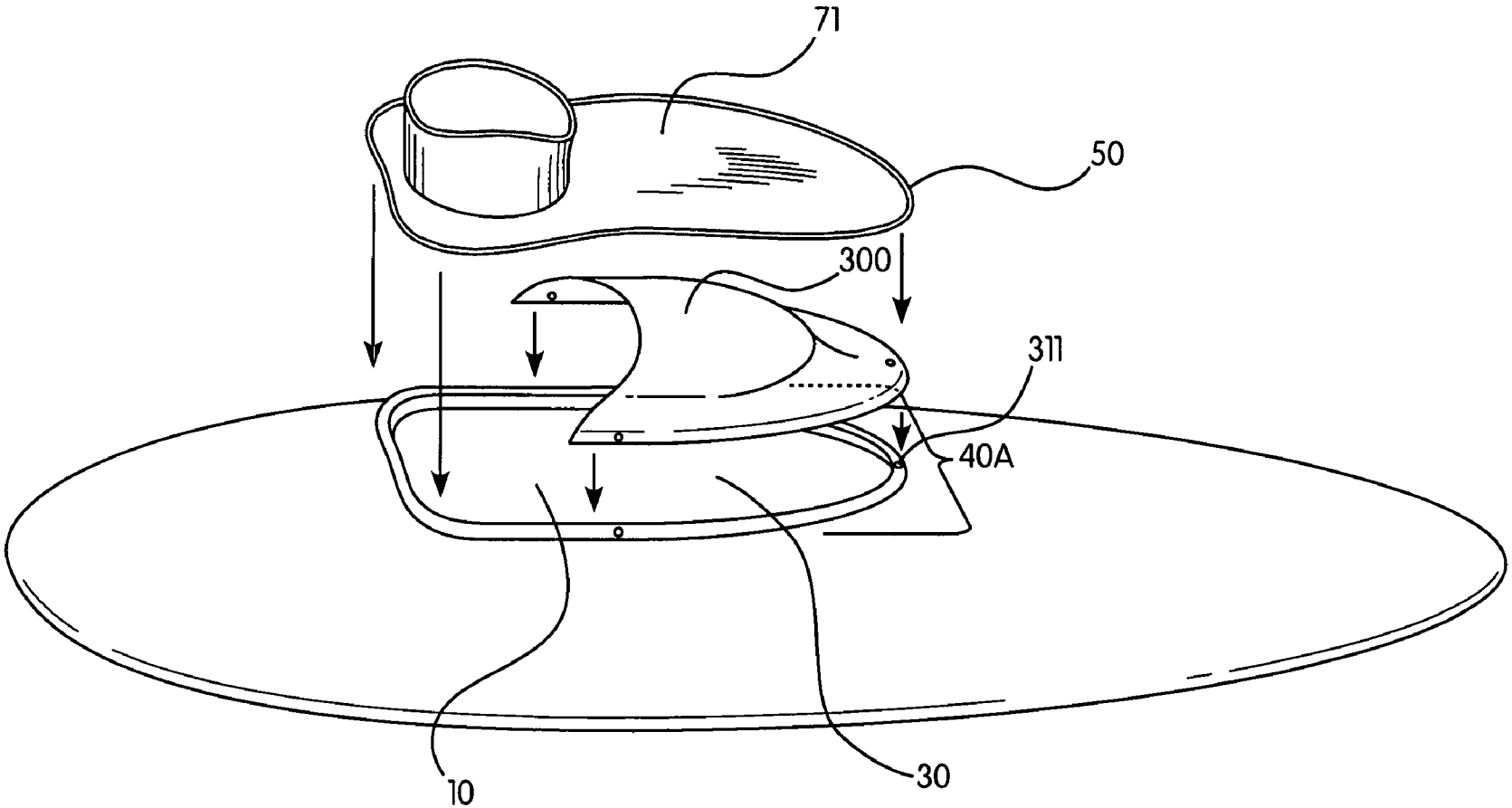
FIGS. 5A, 5B and 5C are a side schematic view, side view and bottom view respectively of a rigid deck plate according to the present invention.
Figure 5C:
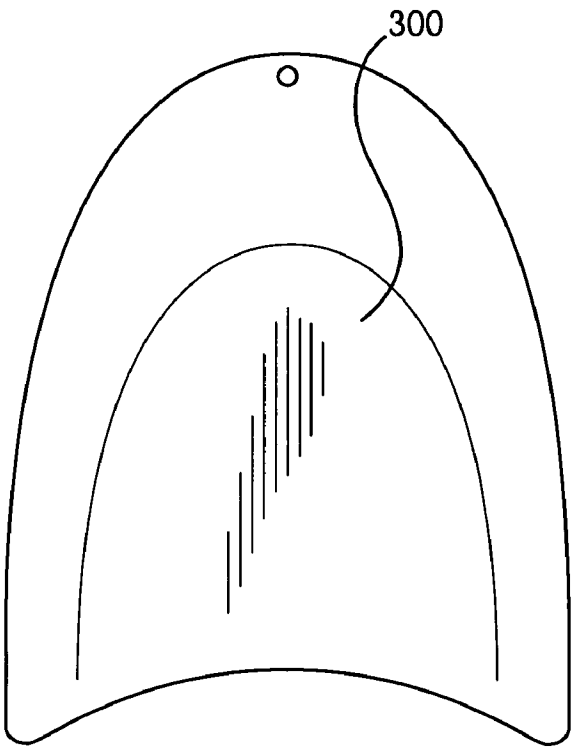
Figure 5B:
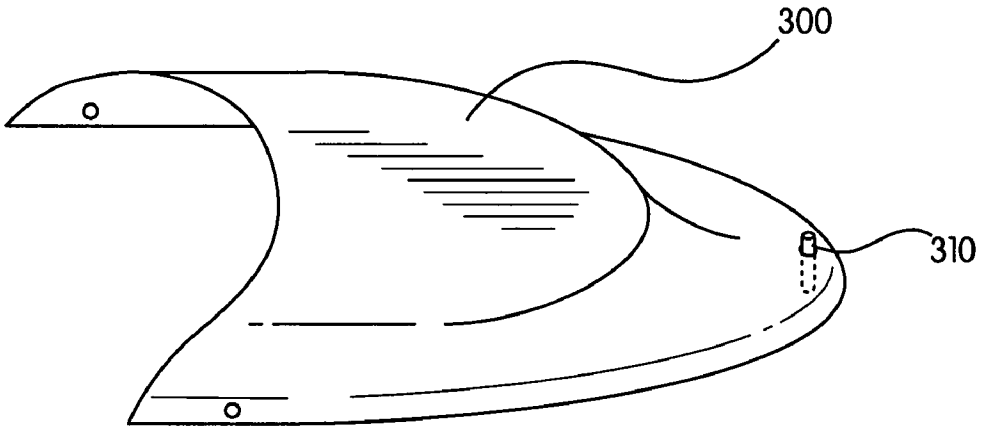

FIGS. 5A, 5B and 5C shows another embodiment of the invention which comprises a rigid deck plate 300 that fits over a front portion 30 of the cockpit opening 10. Preferably, the rigid deck plate 300 is arc-shaped and is congruous with the cockpit rim 40A adjacent to the front portion of the cockpit opening. In the preferred embodiment, the rigid deck plate is held in place by a rivet 310 at the apex of the arc-shaped member 300. The rivet 310 is adapted to be placed in an corresponding opening 311 in the cockpit rim. The skilled artisan will appreciate that the rigid deck plate can be fastened to the cockpit rim in other ways. For example, hooks can be secured to the perimeter of the rigid plate member, said hooks able to wrap around and secure to the cockpit rim. A flexible skirt 71 can then be placed over the rigid deck plate 300. In this way the rigid deck plate provides support to the flexible skirt 71.

Figure 6:
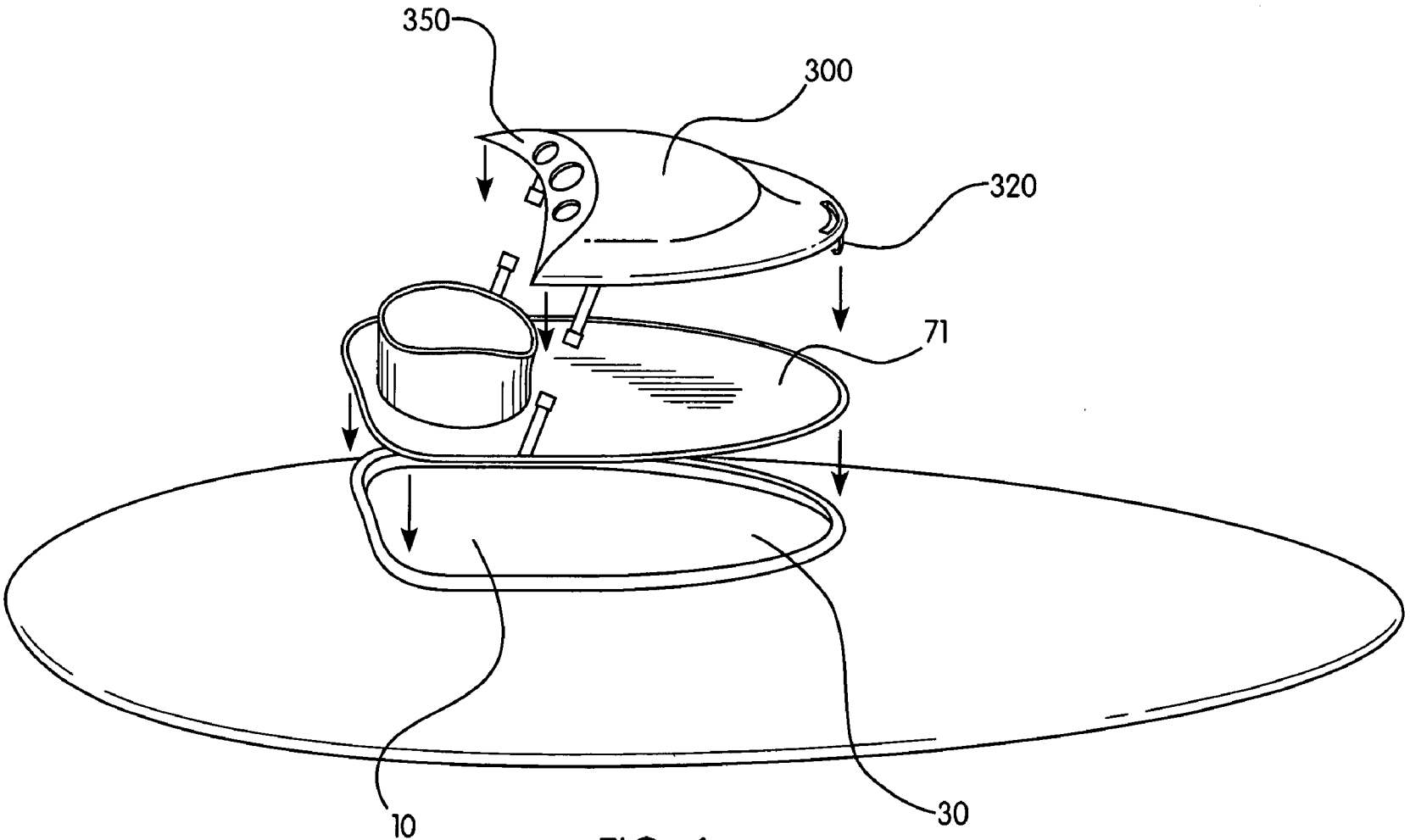
FIG. 6 is a side schematic view of an embodiment of the invention where a rigid deck plate goes over a flexible spray skirt.

In another embodiment shown in FIG. 6 the rigid deck plate 300 fits over a flexible spray skirt. The rigid deck plate can be fastened to the front portion 30 of the cockpit opening 10 by way of that which is described above or any other conventional means, e.g., a hook 320 shown in FIG. 6. The rigid deck plate 300 provides a mounting surface 350 for instruments in addition to providing the benefits described above.

In all embodiments, the present invention eliminates implosions and also maintains the integrity of the shape of the deck of the kayak during submersible maneuvers. The invention also allows navigational devices such as compasses or GPS units to be installed in a waterproof dashboard-like configuration on the skirt, directly in the paddler's field of view.

While presently preferred embodiments have been described and shown, the inventor may be otherwise embodied within the scope of the appended claims.

What is claimed is:

1. A rigid-decked spray skirt for use with a kayak, the kayak having a cockpit opening having a front portion and a rear portion, and a cockpit rim, the spray skirt comprising:

(a) a flexible skirt portion having a front portion and a rear portion, an inward-facing portion, an outward-facing portion, and an edge operable to fit about the cockpit rim;

(b) a rigid deck member under the flexible skirt and spanning the front portion of the cockpit opening and having an inward-facing portion, an outward-facing portion, and two side edges, the side edges capable of resting on the cockpit rim.

2. The spray skirt of claim 1 whereby the flexible skirt portion substantially prevents the rigid member from outward directional movement.

3. The spray skirt of claim 1 wherein the inward facing portion of the flexible skirt portion and the outward-facing portion of the rigid deck member have a fastening means, the respective fastening means operable to engage and detachably secure the rigid deck member to the flexible skirt section.

4. The spray skirt of claim 1 wherein the rigid deck member further comprises an adjustable tensioning means in communication with the two side edge of the ridge deck member, the tensioning means operable to adjust tension on the side edges thereby allowing for adjusting a curvature the peak of the rigid deck member.

5. A rigid deck plate for use with a flexible kayak spray skirt, the kayak having a cockpit opening having a front portion and a back portion and a cockpit rim, the flexible spray skirt having an outward facing surface and an inward facing surface, the rigid deck plate comprising a rigid deck plate having a front-facing edge substantially congruous with the front portion of the cockpit opening and adapted to be placed over the front portion of the cockpit opening.

6. The rigid deck plate of claim 5 further comprising a fastening means to detachably secure the deck plate to the cockpit rim.

7. The rigid deck plate of claim 6 wherein the fastening means is a rivet sized to fit in an opening in the cockpit rim.

8. The rigid deck plate of claim 5 further comprising an inward facing surface and an outward facing surface, said outward facing surface placed underneath the spray skirt and substantially in contact with the inward facing surface of the spray skirt.

9. A rigid deck plate for use with a kayak, the kayak having a cockpit opening having a front portion and a rear portion, and a cockpit rim, the rigid deck plate comprising a rigid deck having a flexible material secured thereto, said rigid deck covering the front portion of the cockpit opening, said flexible material having a securing means capable of securing to the cockpit rim.

10. The rigid deck plate of claim 9, wherein said securing means is a separate material secured to the edge of the skirt.

11. The rigid deck plate of claim 10, wherein said securing means is an elastic material.

12. The rigid deck plate of claim 9 further comprising at least one instrument mounted to a surface of said rigid deck.

13. A rigid deck plate for use with a kayak, said kayak having a cockpit opening having a front portion and a rear portion, and a cockpit rim, said rigid deck plate comprising a rigid deck substantially covering said cockpit opening and having a securing means, said securing means capable of securing to said cockpit rim, wherein said securing means is a separate elastic material secured to an edge of said deck plate.

* * * * *